US009113701B2

(12) United States Patent
Zhu

(10) Patent No.: US 9,113,701 B2
(45) Date of Patent: Aug. 25, 2015

(54) FOLDABLE TABLE/CHAIRS SET

(71) Applicant: Shou Qiang Zhu, Ontario, CA (US)

(72) Inventor: Shou Qiang Zhu, Ontario, CA (US)

(73) Assignee: IP Power Holdings Limited, Hong Kong (CN)

( * ) Notice: Subject to any disclaimer, the term of this patent is extended or adjusted under 35 U.S.C. 154(b) by 97 days.

(21) Appl. No.: 14/036,364

(22) Filed: Sep. 25, 2013

(65) Prior Publication Data

US 2015/0084383 A1 Mar. 26, 2015

(51) Int. Cl.
*A47B 3/14* (2006.01)

(52) U.S. Cl.
CPC ..... *A47B 3/14* (2013.01); *A47B 2003/145* (2013.01)

(58) Field of Classification Search
CPC ..... A47B 3/14; A47B 2003/145
USPC ..... 297/135, 139, 140, 157.1, 159.1
See application file for complete search history.

(56) References Cited

U.S. PATENT DOCUMENTS

| | | | | |
|---|---|---|---|---|
| 1,365,139 | A * | 1/1921 | Winitowy | 190/11 |
| 1,622,327 | A * | 3/1927 | Livingood | 297/139 |
| 2,109,869 | A * | 3/1938 | Ross | 297/143 X |
| 2009/0151607 | A1 * | 6/2009 | McLemore | 108/91 |
| 2012/0175918 | A1 * | 7/2012 | Southwick et al. | 297/135 |
| 2013/0009427 | A1 * | 1/2013 | Johnson et al. | 297/135 |

FOREIGN PATENT DOCUMENTS

WO WO 2010044647 A1 * 4/2010

* cited by examiner

*Primary Examiner* — Anthony D Barfield
(74) *Attorney, Agent, or Firm* — Che-Yang Chen; Law Office of Michael Chen

(57) ABSTRACT

A foldable table/chairs set is disclosed. The foldable table/chairs set may include a foldable table surface; a chair set including a plurality of foldable chairs; and a supporting element that is used to conjugate with the table surface to form a table when the supporting element is fully extended, wherein when the supporting element is folded, a receiving space located at a lower portion of one side of the supporting element is created to receive said folded table surface and chairs therein.

10 Claims, 7 Drawing Sheets

FOLDABLE TABLE/CHAIRS SET

FIELD OF THE INVENTION

The present invention is directed to a set of foldable table and chairs, and in particular to a set of foldable table/chair that can be easily stored and transported.

BACKGROUND OF THE INVENTION

Tables and chairs have always been people's primary furniture ever since the beginning of human civilization. Tables and chairs may serve many purposes and can be used in an outdoor or indoor setting. Traditionally, tables and chairs usually come in one complete piece, which means that they would take up a large space and cannot be conveniently stored. As the purposes for tables and chairs expand, the demand for a novel design of tables and chairs has emerged. Therefore, many different designs of tables and chairs have been developed to meet the need of users in term of conveniences and utilities, particularly the designs of foldable tables and chairs.

Foldable table and chairs are well known and have become common for a multipurpose use at places such as dining rooms, meeting halls, lecture rooms and the like. Such a foldable table/chairs set provides additional utility and convenience to users because it has a smaller profile for storage when it folds. Recently, more and more people love outdoor and recreational activities such as camping, field trips, or Bar-B-Q during their free time because many people may endure high pressure at work, and have accumulated a lot of tension and stress. Not only can these outdoor activities help people release the stress, but also improve quality of life. Since most places for abovementioned outdoor activities do not have all the facilities, it may be more convenient for people if the foldable table/chairs set can be portable and easily transported to the facilities.

U.S. Pat. Pub. No.: 2013/0009427 to Johnson et al. discloses a type of foldable table/chairs with partially open carrying case. The table and chairs in this invention could be folded into a flat platform and put into the partially open carrying case. This invention allows users to minimize the amount of space needed to store the table and chairs. Also it allows users to move table and chairs at ease. However, an unnecessary burden would be placed on users because they have to bring an additional partially open carrying case with them if they want to move the table/chairs set. This would be extremely inconvenient to users, especially when users are transporting the table/chairs set to an outdoor setting in an automobile where the space is already very limited.

Therefore, there remains a need for a new and improved foldable table/chairs set that is more convenient and efficient to store and move the foldable table/chairs set without putting any additional or unnecessary burden on the users.

SUMMARY OF THE INVENTION

It is an object of the present invention to provide a foldable table/chairs set that can be stored and moved more conveniently and efficiently without putting any additional or unnecessary burden on the users.

It is another object of the present invention to provide a foldable table/chairs set that can be conveniently assembled/disassembled and used in almost every flat surface.

It is a further object of the present invention to provide a foldable table/chairs set that uses lightweight materials accompanied by minimum numbers of metal structure for a sturdy support, so the user can easily move the table/chairs set without spending too much effort.

In one aspect, a foldable table/chairs set may include a table surface, a chair set including a plurality of chairs, and a supporting element. Backside of the table surface has a pair of elongated conjugating slots, and a pair of notches located at about center portion of the conjugating slots. In one embodiment, a center bar is pivotally connected to a table frame at the backside of the table surface, and the table surface can be symmetrically folded from the center bar to reduce its size to about fifty percent (50%) comparing with the original.

In one embodiment, the supporting element has two supporting units and which are substantially similar in size and shape. In one embodiment, these two supporting units are rectangular with a conjugating bar on top portion of each supporting units. When a user wants to attach the table surface to the supporting element, he/she can simply align the conjugating slots with the conjugating bars, and push the conjugating bars into corresponding conjugating slots. It is noted that a handle portion is protrudingly disposed at nearly center portion of each conjugating bar, and the handle portions are aligned with and pushed into the notches to strengthen the connection of the table surface and the supporting unit. In another embodiment, the supporting element also includes a pair of wheels and a T-shaped supporting bar to support the structure of the supporting element.

In a further embodiment, the supporting units are further connected with a pair of connecting elements above the pivotal connections at the center portions of the supporting units. In addition to providing support to the supporting units, the connecting elements are used to control the positions of the supporting units. Each of the connecting elements may further include a pair of connecting units. The connecting units are pivotally connected with each other. When the connecting elements are fully extended, two supporting units are disposed as a substantially "X" shape to provide the best support to the table surface.

In an exemplary embodiment, a controlling stick is pivotally connected with the connecting elements, and more specifically, one end of the controlling stick is pivotally connected with one pair of the connecting units, and the other end thereof is pivotally connected with the other pair of the connecting units. When the controlling stick is lifted, the connecting elements are bended accordingly to bring the two supporting units to come closer to reduce the size of the supporting element. A U-shaped holding frame is pivotally connected at a bottom portion of one of the supporting units, and when the two supporting units are disposed as a substantially "X" shape, the holding frame stays substantially parallel with the supporting unit, and when the controlling stick is lifted to bring the two supporting units closer, the holding frame moves away from the supporting unit accordingly until the holding frame is substantially perpendicular to the supporting unit. Meanwhile, the supporting element has reached its smallest size and a receiving space is thus created to receive the folded table surface and chairs.

In still an exemplary embodiment, the size of the folded table surface and chairs is substantially the same as the size of the supporting units. More importantly, the receiving space is designed to receive the folded table along with four folded chairs. In a further embodiment, a cover can be disposed outside the table/chairs set to prevent the set from dust. The user can hold the handle portions together and move the entire table/chairs set as a luggage. It is advantageous that the user does not have to prepare another carrying case to receive the table and chairs because the receiving space is automatically formed when the supporting element is folded.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
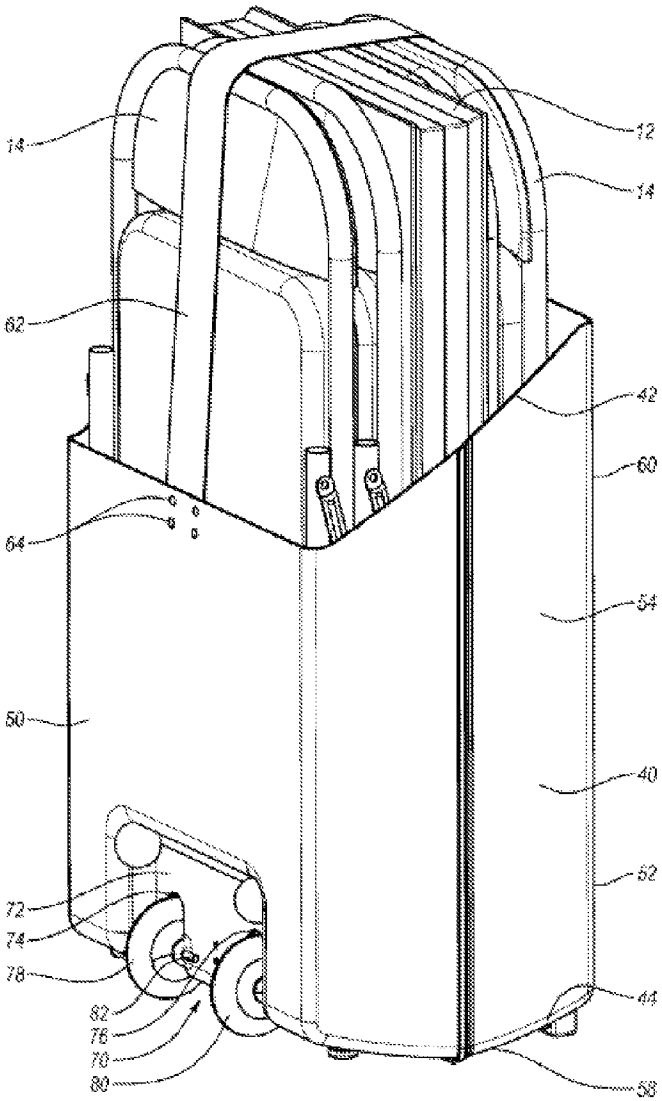
FIG. 1 (Prior Art)
FIG. 1 illustrates a prior art disclosing a foldable table/chairs with partially open carrying case.
Figure 2:
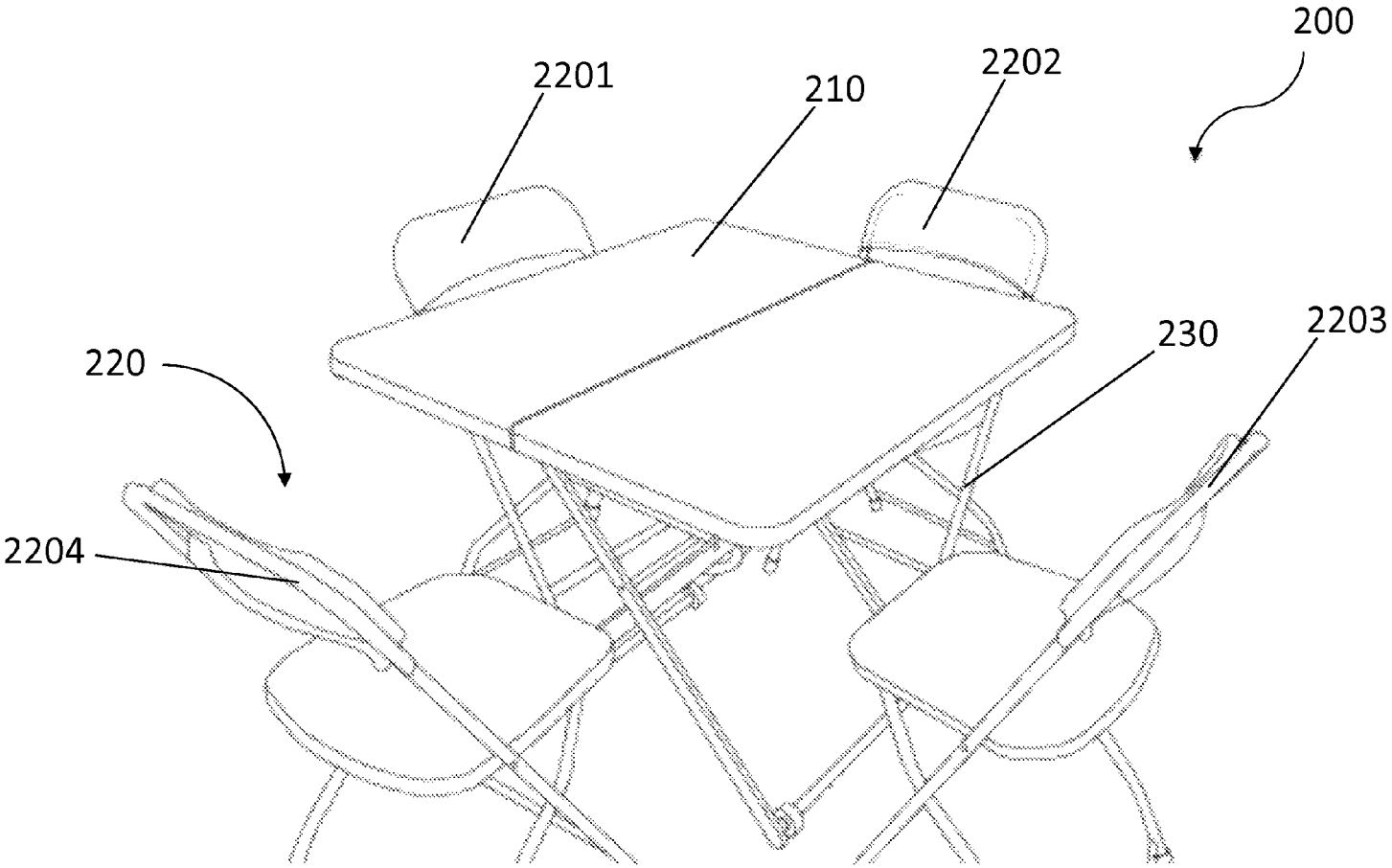
FIG. 2 illustrates a schematic view of the foldable table/chairs set in an unfolded situation in the present invention.
Figure 3:
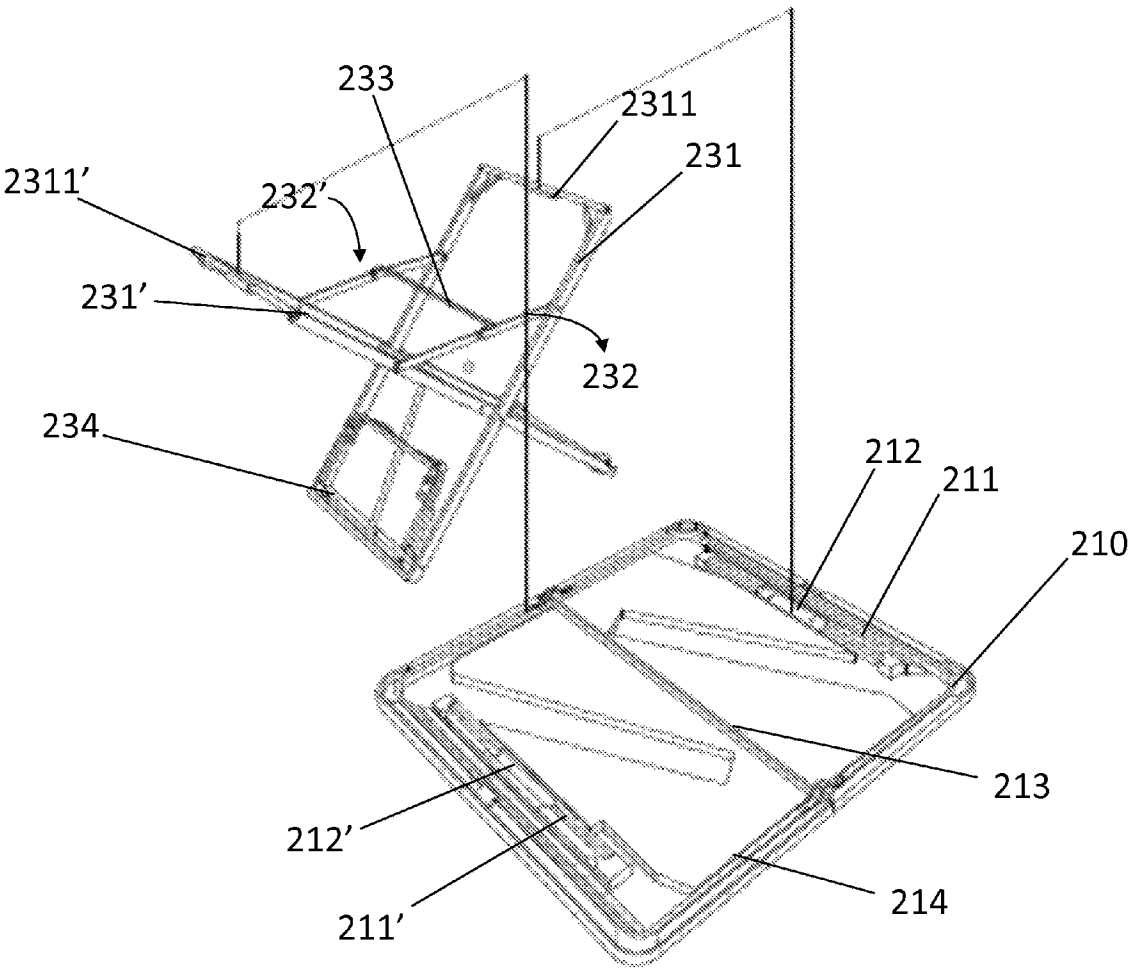
FIG. 3 illustrates a schematic view of the table surface and supporting element when they are detached in the present invention.
Figure 4:
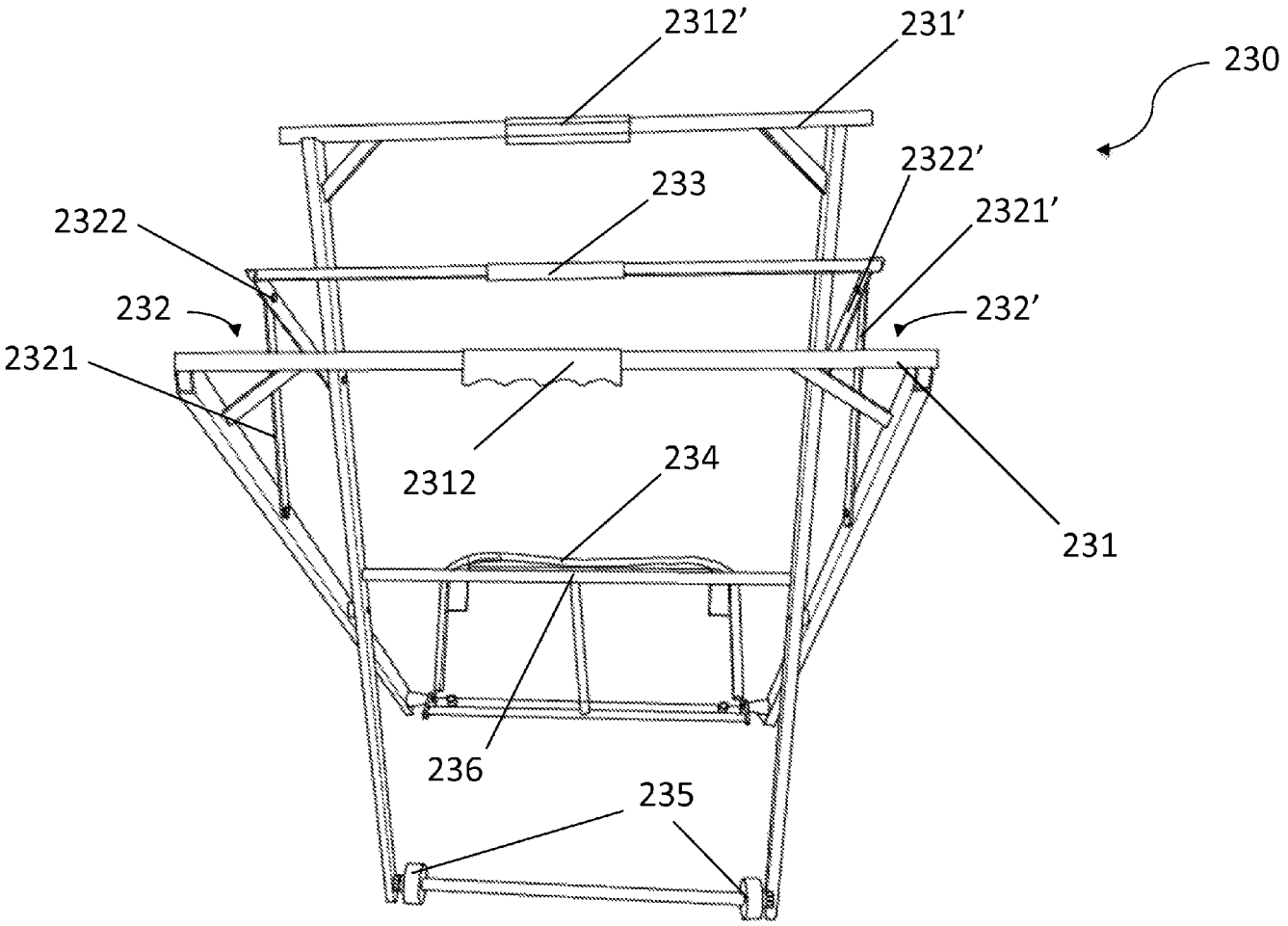
FIG. 4 illustrates a perspective view of the supporting element in the present invention.

In order to further understand the goal, characteristics and effect of the present invention, a number of embodiments along with the drawings are illustrated as following:

Referring to FIGS. 2 to 4, a foldable table/chairs set 200 may include a table surface 210, a chair set 220 including a plurality of chairs and a supporting element 230. Backside of the table surface 210 has a pair of elongated conjugating slots 211 and 211', and a pair of notches 212 and 212' located at about center portion of the conjugating slots 211 and 211'. In one embodiment, a center bar 213 is pivotally connected to a table frame 214 at the backside of the table surface 210, and the table surface 210 can be symmetrically folded from the center bar 213 to reduce its size to about fifty percent (50%) comparing with the original. The chair set 220 has four foldable chairs 2201, 2202, 2203 and 2204.

The supporting element 230 has two supporting units 231 and 231' that are substantially similar in size and shape. In one embodiment, these two supporting units 231 and 231' are rectangular with a conjugating bar 2311 and 2311' on top portion of the supporting units 231 and 231' respectively. When a user wants to attach the table surface 210 to the supporting element 230, he/she can simply align the conjugating slots 211 and 211' with the conjugating bars 2311 and 2311' respectively, and push the conjugating bars 2311 and 2311' into corresponding conjugating slots 211 and 211'. It is noted that a handle portion 2312 (2312') is protrudingly disposed at nearly center portion of each conjugating bar 2311 (2311'), and the handle portions 2312 and 2312' are aligned with and pushed into the notches 212 and 212' to strengthen the connection of the table surface 210 and the supporting element 230. In another embodiment, the supporting element 230 also includes a pair of wheels 235 and a T-shaped supporting bar 236 to support the structure of the supporting element 230.

Still referring to FIGS. 2, 3 and 4, as stated above, the supporting element 230 has two supporting units 231 and 231' pivotally connected together at nearly center portions thereof. The supporting units 231 and 231' are further connected with a pair of connecting elements 232 and 232' above the pivotal connections at the center portions of the supporting units 2311 and 2311'. In addition to providing support to the supporting units 2311 and 2311', the connecting elements 232 and 232' are used to control the positions of the supporting units 231 and 231'. Each connecting elements 232 and 232' may further include a pair of connecting units (2321, 2322) and (2321', 2322'). The connecting units are pivotally connected with each other. When the connecting elements 232 and 232' are fully extended, two supporting units 231 and 231' are disposed as a substantially "X" shape to provide the best support to the table surface 210 as shown in FIG. 2.

Figure 5:
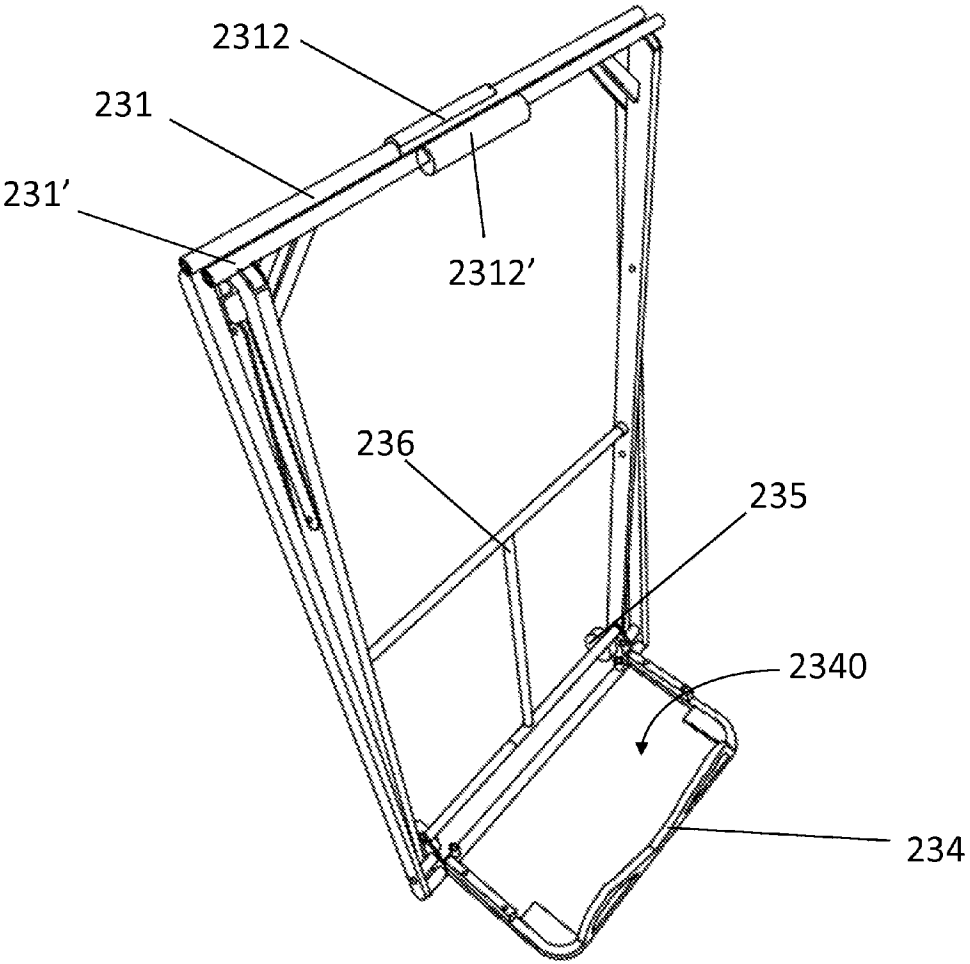
FIG. 5 illustrates a perspective view of the supporting element in the present invention when the supporting element is fully folded.

On the other hand, when the user wishes to disassemble the table/chairs set 200, the table surface 210 is first detached from the supporting element 230. Furthermore, a controlling stick 233 is pivotally connected with the connecting elements 232 and 232', and more specifically, one end of the controlling stick 233 is pivotally connected with one pair of the connecting units (2321, 2322), and the other end thereof is pivotally connected with the other pair of the connecting units (2321', 2322'). When the controlling stick 233 is lifted, the connecting elements 232 and 232' are bended accordingly to bring the two supporting units 231 and 231' to come closer to reduce the size of the supporting element 230 as shown in FIGS. 4 and 5. It is noted that a U-shaped holding frame 234 is pivotally connected at a bottom portion of one of the supporting units 231. When the two supporting units 231 and 231' are disposed as a substantially "X" shape, the holding frame 234 stays substantially parallel with the supporting unit 231 (see FIG. 3), and when the controlling stick 233 is lifted to bring the two supporting units 231 and 231' closer to fold the supporting element 230, the holding frame 234 moves away from the supporting unit 231 accordingly until the holding frame 234 is substantially perpendicular to the supporting unit 231 as shown in FIG. 5. Meanwhile, the supporting element 230 has reached its smallest size and a receiving space 2340 is thus created at the bottom portion of the supporting unit 231.

Figure 6:
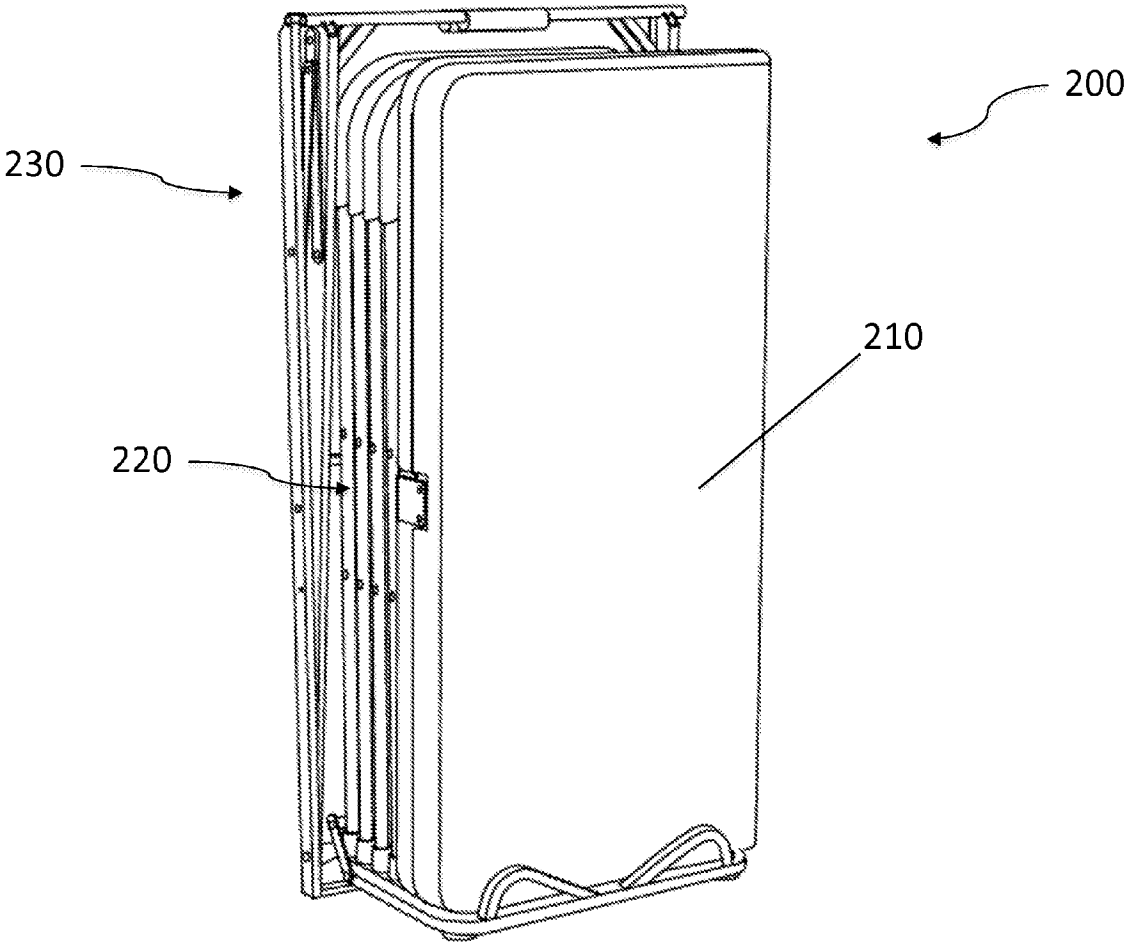
FIG. 6 illustrates a schematic view of the table/chairs set in a fully folded situation in the present invention.
Figure 7:
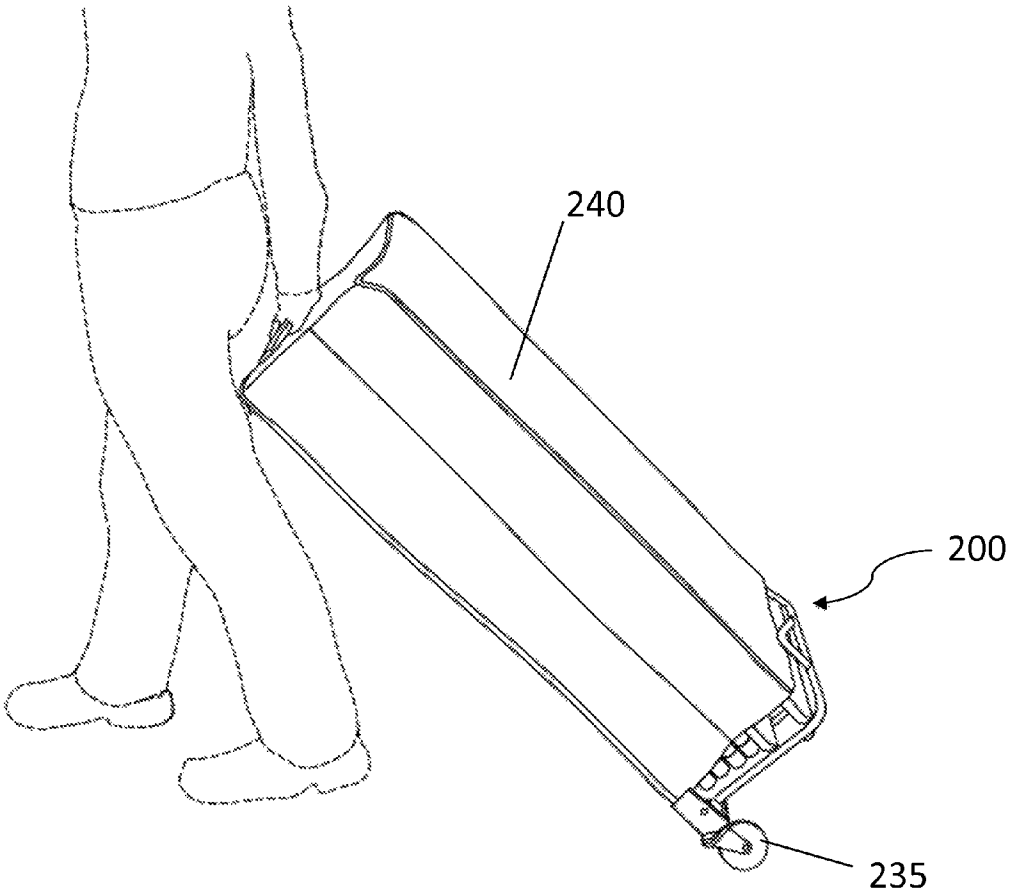
FIG. 7 illustrates a schematic view of the table/chairs set that is moved by the user in the present invention.

As stated above, the table surface 210 and the chairs 2201 to 2204 are all foldable. In an exemplary embodiment, the size of the folded table surface and chairs is substantially the same as the size of the supporting units 231 and 231'. More importantly, the receiving space 2340 is designed to receive the folded table 210 along with four folded chairs 2201 to 2204, as shown in FIG. 6. In a further embodiment, a cover can be disposed outside the table/chairs set 200 to prevent the set from dust. The user can hold the handle portions 2312 and 2312' together and move the entire table/chairs set 200 as a luggage as shown in FIG. 7. It is advantageous that the user does not have to prepare another carrying case to receive the table and chairs because the receiving space 2340 is automatically formed when the supporting element 230 is folded.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A foldable table/chairs set comprising:

a foldable table surface;

a chair set including a plurality of foldable chairs; and a supporting element that is used to conjugate with the table surface to form a table when the supporting element is fully extended;

wherein when the supporting element is folded, a receiving space located at a lower portion of one side of the supporting element is created to receive said folded table surface and chairs therein, wherein a backside of the table surface has a pair of elongated conjugating slots, and a pair of notches located at nearly center portion of the conjugating slots, and a center bar is pivotally connected to a table frame at the backside of the table surface, and the table surface is symmetrically folded from the center bar to reduce its size; and wherein the supporting element has two rectangular supporting units that are substantially similar in size and shape and pivotally connected together at center portion of each of the supporting units, and each of the supporting elements has a conjugating bar on a top portion of each of the supporting units, and the table is formed when the conjugating bars are aligned with and pushed into corresponding conjugating slots.

2. The foldable table/chairs set of claim 1, wherein the supporting units are further connected with a pair of connecting elements above the pivotal connections at the center portions of the supporting units.

3. The foldable table/chairs set of claim 2, wherein a controlling stick is pivotally connected to the connecting elements, and when the controlling stick is lifted, the connecting elements are bended accordingly to bring the two supporting units to come closer to reduce the size of the supporting element.

4. The foldable table/chairs set of claim 3, wherein a U-shaped holding frame is pivotally connected at a bottom portion of one of the supporting units, and the holding frame is substantially parallel to the supporting unit when the supporting element is fully extended.

5. The foldable table/chairs set of claim 4, wherein the U-shape holding frame moves away from the supporting unit when the controlling stick is lifted to bring said two supporting units together to fold the supporting element until the holding frame is substantially perpendicular to the supporting units, and a receiving space is created at the bottom portion of one of the supporting units.

6. The foldable table/chairs set of claim 5, wherein size the receiving space is used to receive said folded table surface and at least one foldable chair.

7. The foldable table/chairs set of claim 1, wherein a U-shaped holding frame is pivotally connected at a bottom portion of one of the supporting units, and the holding frame is substantially parallel to the supporting unit when the supporting element is fully extended.

8. The foldable table/chairs set of claim 1, wherein a cover is used to prevent the folded table/chairs set from dust.

9. The foldable table/chairs set of claim 8, wherein a pair of wheels is located at one side of the supporting unit, so the folded table/chairs set is portable.

10. The foldable table/chairs set of claim 1, wherein a pair of wheels is located at one side of the supporting unit, so the folded table/chairs set is portable.

* * * * *